United States Patent [19]

Juang

[11] Patent Number: 4,854,420

[45] Date of Patent: Aug. 8, 1989

[54] SECURING MEANS FOR A DOUBLE STEP LADDER

[76] Inventor: Yuan C. Juang, No. 106-1, Chungshan Rd., Wu Jih Hsiang, Taichung Hsien, Taiwan

[21] Appl. No.: 271,535

[22] Filed: Nov. 15, 1988

[51] Int. Cl.[4] ..... E04C 1/30

[52] U.S. Cl. ..... 182/166; 182/207

[58] Field of Search ..... 182/166, 167, 201, 207

[56] References Cited

U.S. PATENT DOCUMENTS

| | | | |
|---|---|---|---|
| 497,712 | 5/1893 | Eichelberger | 182/166 |
| 658,395 | 9/1900 | Pfeiffer | 182/166 |
| 947,409 | 1/1910 | Hudson | 182/166 |
| 1,495,197 | 5/1924 | Oakley | 182/166 |
| 2,320,144 | 5/1943 | Johnson | 182/201 |
| 2,587,659 | 3/1952 | Smith | 182/201 |
| 4,298,093 | 11/1981 | Wing | 182/167 |
| 4,412,599 | 11/1983 | McCrudden | 182/201 |

*Primary Examiner*—Reinaldo P. Machado

[57] ABSTRACT

A securing means for a double step ladder having a U-shaped element, a coupling element, a retaining rod received within the openings provided on the distal ends of the lateral walls of the U-shaped element, a flap fixed on the lateral wall of the U-shaped element to receive the retaining rod, and a cap to engage with the retaining rod. The securing means is mounted on a step ladder, in which the upper and lower legs of the ladder are clamped among the U-shaped element, the coupling element and the retaining rod. The position of the upper and lower legs is adjustable by the engagement of the retaining rod with the cap. The retaining rod has two horizontally protruding plates on both of which a hole is provided to receive a cylindrical pivot piece which has an eccentric protrusion provided on upper and lower surfaces and a cavity provided on a cylindrical surface to receive a pivot rod which is rotatable to cause a radial movement of the pivot piece urging against the U-shaped element.

3 Claims, 5 Drawing Sheets

SECURING MEANS FOR A DOUBLE STEP LADDER

BACKGROUND OF THE INVENTION

The present invention relates to a securing means for retaining the upper and lower legs of a double step ladder in a predetermined position, and more particularly relates to a securing means which is easily mounted to adjust the length of each main leg of the double step ladder.

Various types of securing apparatuses have been employed in many parts of the world for application to a double step ladder; for example, a securing chain, a pivot retaining apparatus or the like. Furthermore, many adjustable elements are applied to another type of double step ladder in which a main leg comprises an upper and a lower leg to enable the variation of the length of the double step ladders to meet different requirements. However, the employment of such conventional double step ladders is dangerous when the user stands thereon due to over-compression, accidental bending and wearout factors. The present invention can actually obviate and/or mitigate the above-mentioned drawback.

SUMMARY OF THE INVENTION

A primary objective of the present invention is to provide a securing means for a double step ladder of which each of the main legs has an upper and a lower leg and wherein the length extended by the upper and lower legs is adjustable with the aid of such a securing means, and the engagement of the securing means is stable enough to prevent the possibility of loosing.

Another objective of the present invention is to provide a securing means for a double step ladder which has performance characteristics superior to any heretofore available.

Still another objective of the present invention is to provide a securing means for a double step ladder which is easily manufactured and assembled on the double step ladder.

Further objectives and advantages of the present invention will become apparent as the following description proceeds, and the features of novelty which characterize the invention will be pointed out with particularity in the claims annexed to and forming a part of this invention.

DETAILED DESCRIPTION OF THE PREFERRED EMBODIMENT

Figure 1:
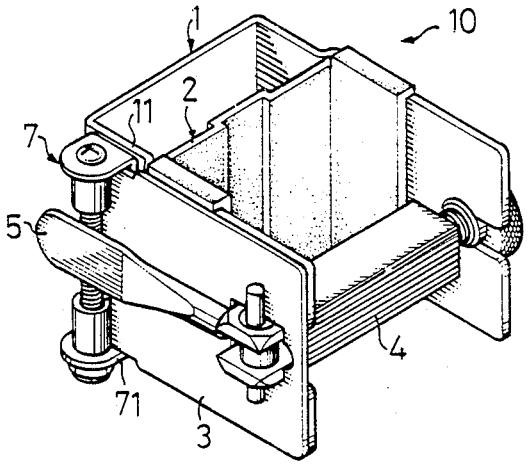
FIG. 1 a perspective view of a securing means for a double step ladder in accordance with the present invention.
Figure 3:
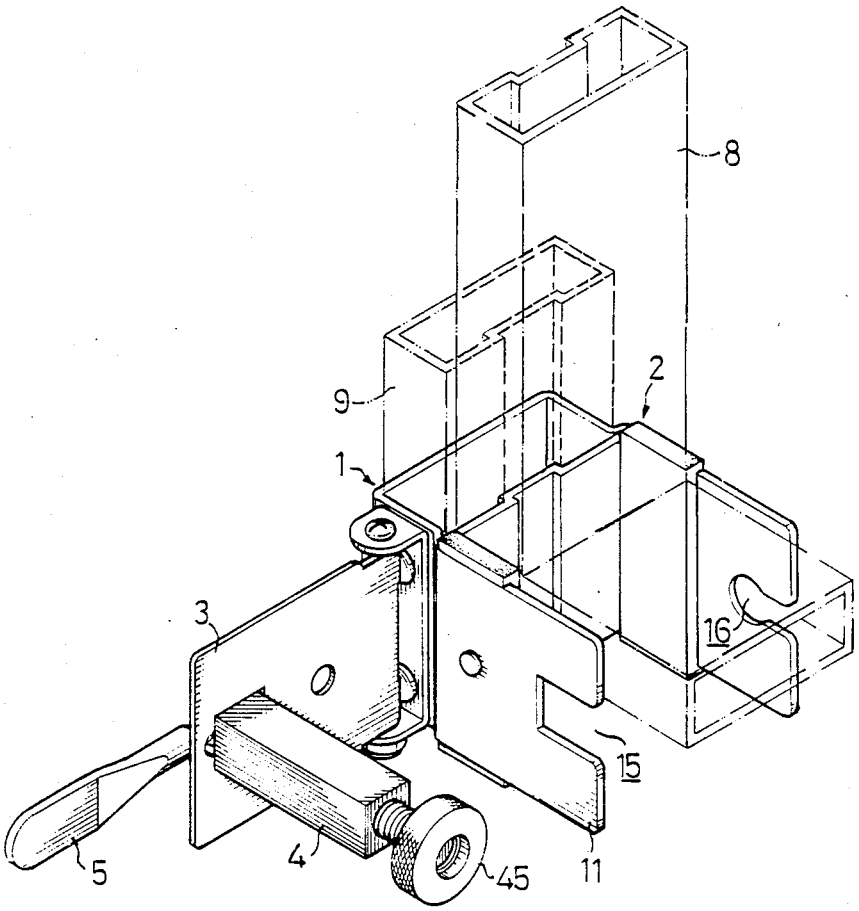
FIG. 3 a schematic view of the securing means of FIG. 1, illustrating the mounting of the securing means on the double step ladder, wherein the pivot rod is rotated away from the body of the U-shaped element.

With reference to the drawings and particular to FIGS. 1 and 3 thereof, it can be seen that a securing means 10 for a step ladder in accordance with the present invention comprises a substantially U-shaped element 1, a coupling element 2 interposed between a first (upper) leg 8 and a second (lower) leg 9 of a double step ladder, a flap 3, a retaining rod 4 and a pivot rod 5 mounted on the retaining rod 4.

Figure 2:
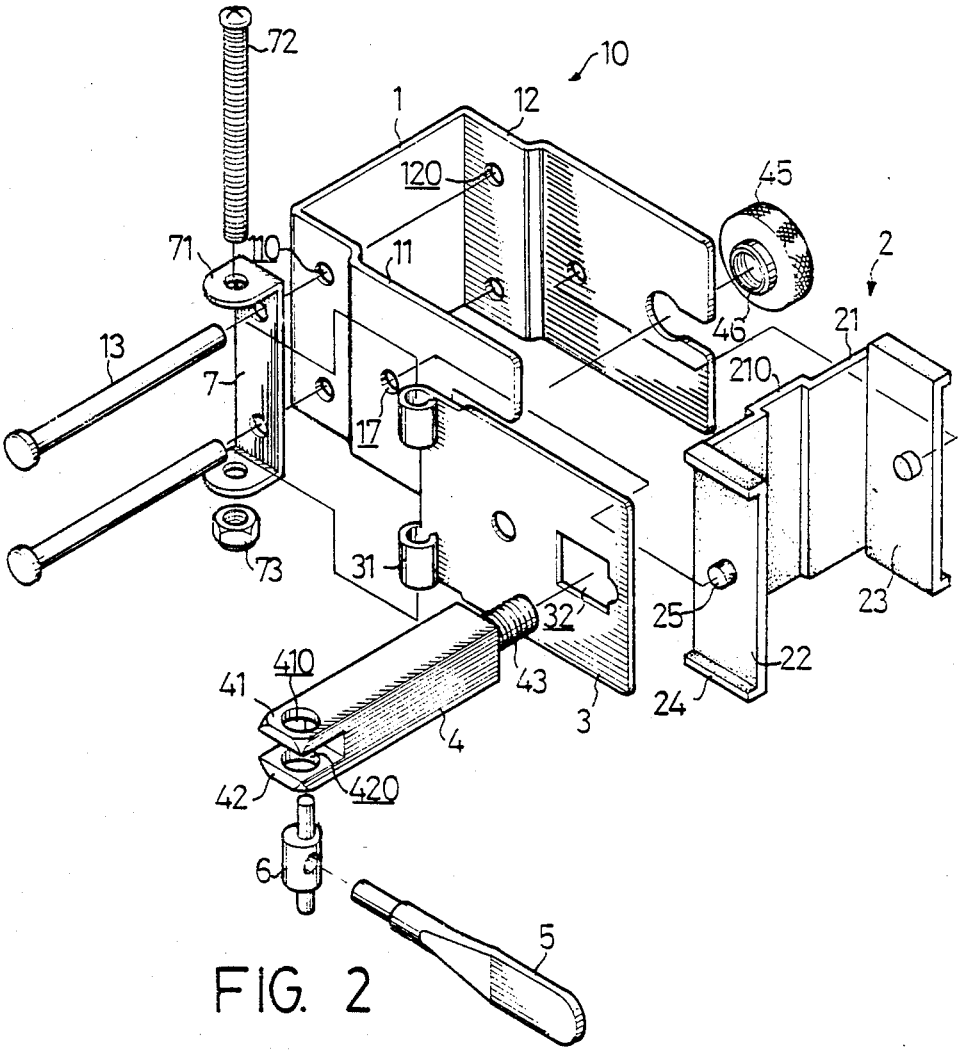
FIG. 2 is an exploded view of the securing means of FIG. 1.

Referring to FIG. 2, it can be seen that the U-shaped element 1 has two lateral walls 11, 12 extending therefrom, wherein a plurality of respective holes 110, 120 are provided thereon for receiving respective securing pins 13 to combine the U-shaped element 1 and lower leg 9. Between the securing pin 13 and the lateral wall 11, a mounting plate 7 is provided with a pair of trunnions 71 and is fixed on the U-shaped element 1 by the securing pins 13.

After the securing pins 13 inserting into the U-shaped element 1 through the mounting plate 7, a hinge means 31 provided on the lateral rim of the flap 3 is positioned between the trunnions 71 and receives a screw 72 engaged with a nut 73. This pivottedly secures the flap 3 on the U-shaped element 1. A slot 31 is provided on the central portion of the flap to receive the retaining rod 4 which is placed within openings 15 and 16 provided on the lateral ends of both the lateral walls 11 and 12 after the coupling element 2 is accommodated within the U-shaped element 1. It should be noted that the slot 31 is aligned with the openings 15 and 16; therefore, the retaining rod 4 can be positioned within the openings 15 and 16 after being mounted on the flap 3, as shown in FIG. 3.

The coupling element 2 comprises a main part 21 with a ridge 210, and two side parts 22, 23 which laterally extend from the main part 21. The shape of the ridge 210 corresponds to the external shape of the lower leg 9 and the shape of the inner surface of the main part 21 corresponds to the external shape of the upper leg 8. A stop means 24 is provided on the upper and lower rims of the side parts 22 and 23 to clamp the lateral walls 11 and 12 of the U-shaped element 1. This secures the coupling element 2 on the U-shaped element 1 without sliding movement. Moreover, a protuberance 25 is disposed on the external surface of the parts 22 and 23 to be locked in a hole 17 provided on the lateral walls 11 and 12 to further secure the coupling element 2 within the U-shaped element 1.

The retaining rod 4 has two horizontally protruding plates 41 and 42 on a distal end thereof. Each of these plates 41 and 42 has a respective hole 410, 420 to receive a cylindrical pivot piece 6. Opposite to the protruding plates 41 and 42 oin the rod 4, a threaded rod 43 is provided to be slidable with the opening 16 and is engaged with a cap 45 from the outside of the U-shaped element 1. As can be seen in FIG. 2, the opening 16 has an irregular shape; that is, the opening 16 has an annular portion and a parallel portion The annular portion receives the contact end 46 of the cap 45 so that the cap 45 is fixed thereon while the retaining rod 4 is disposed within the openings 15 and 16 and threadably engaged with the cap 45.

The pivot piece 6 has a protrusion 61 eccentrically provided on the upper and lower surfaces thereof and a cavity 62 provided on the cylindrical surface thereof to receive the pivot rod 5. With the pivot piece 6 lodged between the pivot plates 41 and 42, the retaining rod 4 is kept on the flap 3 and is slidable on the U-shaped element 1 by loosing the engagement of the threaded rod 43 and the cap 45, shown in FIG. 3. Moreover, while the rod 4 is mounted within openings 15, 16 and is engaged with the cap 45, due to the eccentricity of the pivot piece 6, the rotation of the pivot rod 5 causes the radial movement of the pivot piece 6 and then urges the pivot piece 6 against the lateral wall 11. Furthermore, the securing means 10 provides a further clamping force on the upper and lower legs 8 and 9 by the action of the rotation of the pivot rod 5, shown in FIG. 1.

Figure 4:
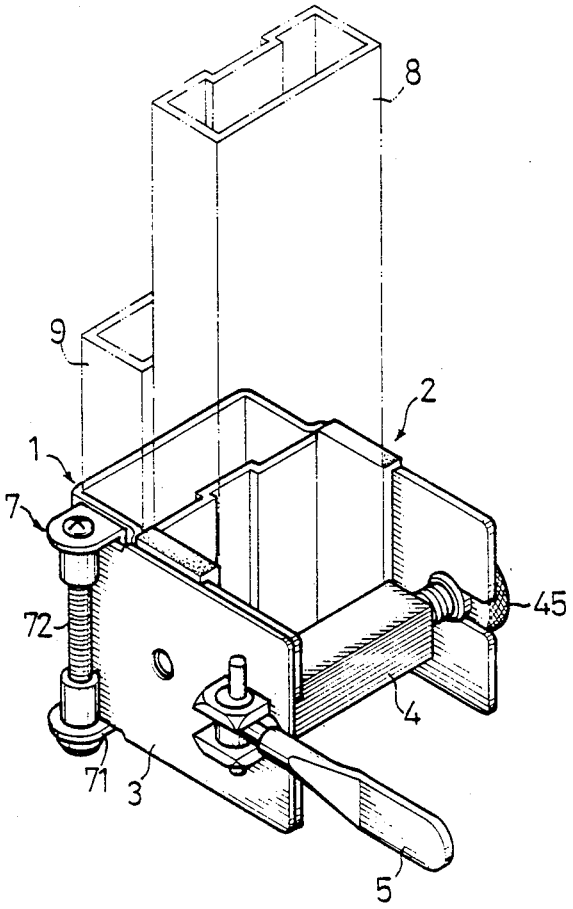
FIG. 4 is another schematic view, similar to FIG. 3, of the securing means, except that the pivot rod is secured within the body of the U-shaped element.
Figure 5:
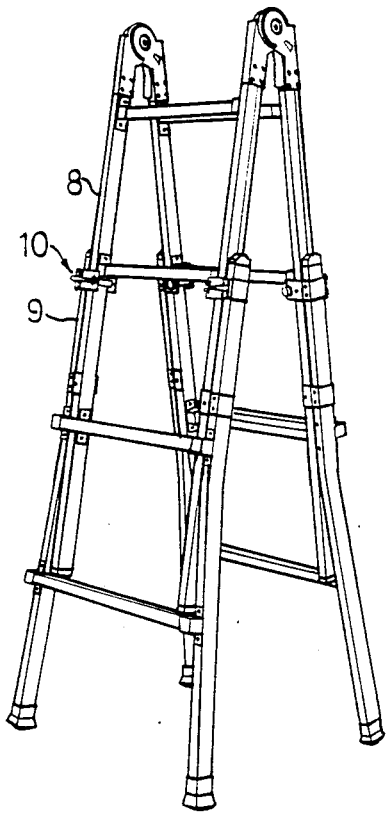
FIG. 5 is an elevational view showing the arrangement of the securing means of FIG. 1 on a double step ladder.

Particularly referring to FIG. 4, it can be seen that the shift of the securing means 10 is easily achieved by rotating the pivot rod 5 to its original position (remote from the U-shaped element 1) and loosing the engagement between the pivot rod 4 and the cap 45. In FIG. 5, a preferred embodiment discloses an arrangement of the securing means 10 on a step ladder.

While the invention has been explained in relation to its preferred embodiment, it is to be understood that various modifications thereof will become apparent to those skilled in the art upon reading this specification. Therefore, it is to be understood that the invention disclosed herein is intended to cover such modifications as fall within the scope of the appended claims.

I claim:

1. A securing means for a double step ladder comprising a U-shaped element to encompass a first leg of said step ladder, a coupling element to be interposed between said first and a second legs of said ladder, a flap, a retaining rod, and a cap to engage with said retaining rod, wherein said U-shaped element has a plurality of holes to receive respective securing pins which insert through said ladder to secure said U-shaped element and ladder together; openings are provided on lateral ends of two lateral walls of said U-shaped element to receive said retaining rod;

said coupling element comprises a main part and two side parts extending from said main part; a stop means is provided on upper and lower rims of said side parts to clamp said lateral walls to secure said coupling element thereon without sliding movement;

said flap is pivotedly provided on one of said lateral walls; a slot is provided on said flap to receive said retaining rod;

said retaining rod has two horizontally protruding plates thereon, a respective hole is provided on said horizontally protruding plates to receive a cylindrical pivot piece; said retaining rod has a threaded rod which is engaged with said cap from the outside of said U-shaped element to retain said first and second legs within said securing means; and said pivot piece lodged between said protruding plates has an eccentric protrusion provided on upper and lower surfaces thereof and a cavity provided on a cylindrical surface thereof to receive a pivot rod for rotating said pivot piece urging against said U-shaped element.

2. A securing means as set forth in claim 1, wherein a mounting plate is interposed between said securing pins and said U-shaped element and has trunnions to pivottedly receive said flap.

3. A securing means as set forth in claim 1, wherein a protuberance is disposed on an external surface of said side parts to be locked in a hole provided on said lateral walls to further secure said coupling element within said U-shaped element.

* * * * *